United States Patent [19]

Grosso et al.

[11] Patent Number: 4,519,438

[45] Date of Patent: May 28, 1985

[54] OPENING FOR INJECTING A PROTECTIVE GAS INTO A CASTING TUBE

[75] Inventors: Roberto Grosso, Kraainem; Tom P. Hamilton, Tervuren, both of Belgium

[73] Assignee: Vesuvius International Corporation, Wilmington, Del.

[21] Appl. No.: 494,465

[22] Filed: May 13, 1983

[30] Foreign Application Priority Data

May 13, 1982 [BE] Belgium ..... 208080

[51] Int. Cl.[3] ..... B22D 11/00

[52] U.S. Cl. ..... 164/415; 164/475; 164/337; 164/259; 222/591

[58] Field of Search ..... 164/415, 475, 337, 437, 164/259, 66.1; 222/591, 594, 603

[56] References Cited

U.S. PATENT DOCUMENTS 4,079,869 3/1978 Meier et al. ..... 222/600

FOREIGN PATENT DOCUMENTS 2013856 1/1978 United Kingdom .

*Primary Examiner*—Nicholas P. Godici
*Assistant Examiner*—G. M. Reid
*Attorney, Agent, or Firm*—Sughrue, Mion, Zinn, Macpeak and Seas

[57] ABSTRACT

A casting tube 8 of a refractory material comprises at its upper end a series of openings for the injection of a protective gas, for example argon, to create an atmosphere which protects the incoming molten metal against oxidation and cools the walls of the casting tube. The injection openings are grooves 11 formed in an upper frustoconical part of the casting tube, whose outer surface defines a fixing collar. These grooves are interconnected by an annular passage 12.

5 Claims, 4 Drawing Figures

OPENING FOR INJECTING A PROTECTIVE GAS INTO A CASTING TUBE

BACKGROUND OF THE INVENTION

The present invention relates to a casting tube of refractory material which, at its upper end, comprises openings for the injection of a protective gas to prevent oxidation of the molten metal and to cool the walls of said casting tube. More particularly, the invention relates to a casting tube provided with openings for the injection of a protective gas having a particular shape and arrangement.

The present invention is used widely in the continuous casting of steel during which the steel is discharged from a casting ladle into a degassing chamber or into a basket and from there into a mould or into an ingot mould.

The duration of the casting operation and the large contact surface which the metal presents to the air makes it essential to use means establishing a protective atmosphere to protect all the exposed surfaces of the metal against oxidation,

PRIOR ART

British Pat. No. 2,013,856 describes a method and an apparatus for controlling the rate of submerged pouring of molten metal from a molten metal supply vessel, for example in the operation of a continuous casting mold.

The upper end of the pouring tube is engaged in a central recess provided in the undersurface of a refractory bloc comprised in a tube support plate. The recess is fitted with a metal shim and is connected to an annular passage through which a protective gas is injected.

The function of the metal shim is to baffle the flow of gas through the annular passage by preventing the infiltration of molten metal into said passage.

This techinque of injecting gas into the pouring tube has the grave drawback that it does not prevent the obstruction of a part or even of the whole orifice of injection by solidified metal.

On the other hand, U.S. Pat. No. 4,079,869 describes an arrangement for replacing the casting tube fitted to the discharge opening of a casting ladle. The stream of gas, which is generally argon, is used above all for cooling the casting tube. The gas is fed in over simple ramps which distribute it as quickly as possible over the surfaces to be protected. As in the arrangement described above, the gas ducts are formed in the removable arms of the supporting frame. The injection openings are formed in the annular collar against which rest the tube and the fixing yoke.

These circular openings are level with the inner wall of the tube without any particular protection. Experience has shown that it is not possible uniformly to introduce the inert gases over the inner surface of the casting tube or universally to reduce the oxygen content to a sufficiently low level to render oxidation of the metal negligible.

The reduced dimensions of these openings promote their rapid obstruction during each interruption in the casting operation. Accordingly, protection of the metal by a gas is difficult to obtain and, if carried out summarily as described in the prior art, has every chance of being purely illusory.

SUMMARY OF THE INVENTION

The object of the present invention is to obviate the disadvantages mentioned above. The present invention relates to a casting tube of refractory material which, at its upper end, comprises openings for the injection of a protective gas during casting into the flux of molten metal to prevent oxidation thereof and to cool the walls of the casting tube, this tube being essentially characterized in that it has a frustoconical section to which is fixed an assembly collar intended to apply it to a base plate of a discharge opening of a casting ladle and in which injection grooves are formed along circumferentially spaced generatrices of the frustum, these injection grooves being interconnected at their upper end by an annular duct which communicates through a supporting ring with a source of protective gas.

According to one aspect of the invention, the above-mentioned injection grooves are distributed at regular intervals along the above-mentioned frustoconical section.

According to another aspect of the invention, the source of protective gas is a source of inert gas, particularly argon.

DETAILED DESCRIPTION OF THE PREFERRED EMBODIMENTS

Figure 1:
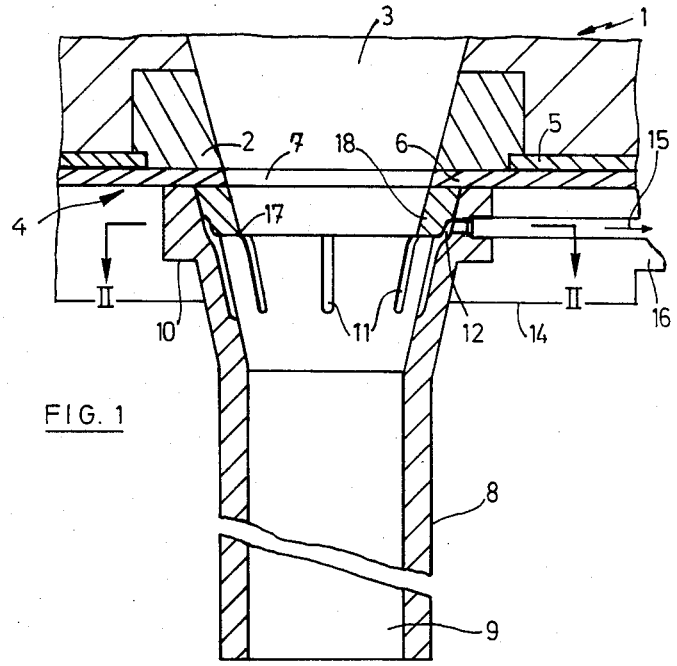
FIG. 1 is a longitudinal section through a casting tube according to the invention of which the fixing collar is fixed to the upper edge of the tube.
Figure 2:
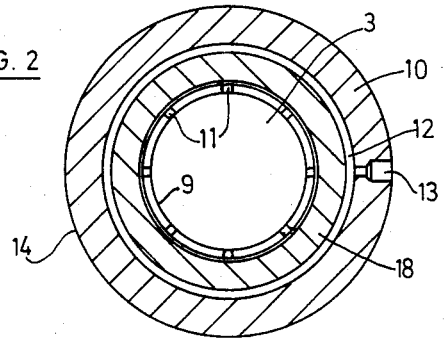
FIG. 2 is a plan view of the casting tube illustrated in FIG. 1.

As illustrated in FIG. 1, the gas injection system according to the invention is placed at the bottom of a casting ladle, generally denoted by the reference 1, and intended to treat a bath of molten metal. A base plate 2 surrounds a discharge opening 3 of the casting ladle 1 provided with a shut-off assembly 4.

The shut-off assembly 4 is formed by a removable anchoring plate 5 of refractory material optionally made up of several elements 6 each having an opening 7 to which is fixed a casting tube 8 comprising a cylindrical flow passage 9 of predetermined diameter.

The upper part of the casting tube 8 is widened. It carries a fixing collar 10 which is intended to fix or mount the casting tube 8 to the base plate 2 provided with the discharge opening 3 of a casting ladle. The widened part is in fact a frustum situated in the extension of the channel of the casting tube 8.

Injection grooves 11 are formed along circumferentially spaced generatrices of this frustum. These grooves 11 are joined together at their upper end by an annuar duct 12 optionally formed in the body of the fixing collar 10 of the tube 8. A radial line 13 connects the annular duct 12 via a supporting ring 14 to an inert gas source 15, optionally through trunnion arms 16.

In the operating position, the widened part of the casting tube 8 is situated below a constriction 17 in the discharge opening 3 of the casting ladle 1.

The fixing collar 10 of the casting tube 8 shown in FIG. 1 surrounds the upper edge of the widened part of the casting tube 8. The circular 12 is formed by the annular wall of the fixing collar 10 and the base of a cylindrical or frustoconical part 18 which fits into the casting tube to form the constriction 17 in the casting channel.

This constriction 17 acts like a Venturi tube during the casting operation and creates a reduced pressure.

Under the effect of this reduced pressure, a protective gas or protective gas mixture is drawn during casting into the casting tube 8 through the injection grooves formed therein and is distributed along the walls of the casting tube 8 to protect the exposed surfaces of the metal against oxidation.

In effect, the presence of air in the casting tube reduces the quality of the cast metal due to the formation of exogenous blow holes caused by the air mechanically entrained during the casting operation. In addition, the oxidized metal tends to stick in the casting tube 8 and to form a film of oxides which, in the case of an ingot mould, may be the cause of skin faults.

Above all, the present invention enables the injection grooves to be kept free, even when the casting operation is interrupted.

By keeping all the injection openings free and unblocked, the invention enables the protective gas to be uniformly distributed. Accordingly, the oxygen content around the metal may be reduced to a sufficiently low level for oxidation to become negligible.

The injection of a protective gas also enables the inner wall of the casting tube 8 of refractory material to be cooled. This tube 8 is subjected to heavy thermal and chemical attack. It undergoes among other things considerable erosion. The injection of a protective gas enables this erosion to be reduced or partly avoided. Accordingly, the casting tube 8 has to be replaced less frequently. It is because the casting tube had to be frequently replaced that a supporting yoke was provided to keep it in position.

Figure 3:
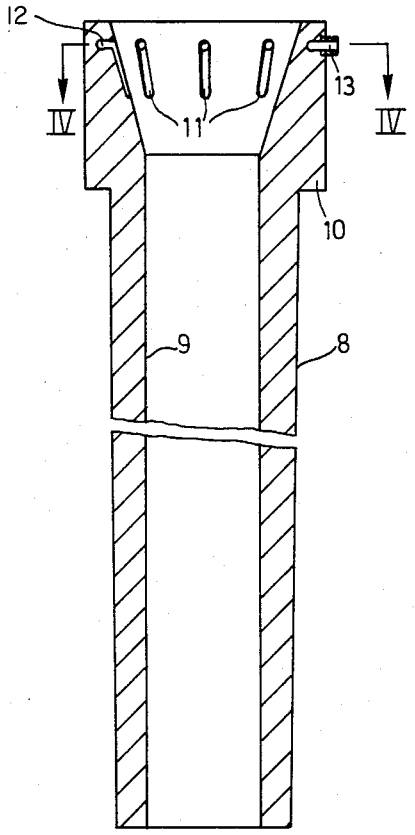
FIGS. 3 and 4, which are similar to FIGS. 1 and 2, illustrate a casting tube of which the annular duct is formed in the fixing collar.
Figure 4:
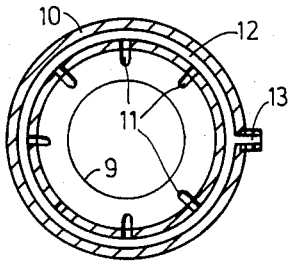

In a second embodiment illustrated in FIGS. 3 and 4, the fixing collar surrounds the entire frustoconical part of the casting tube to form a more solid assembly.

This second embodiment is sufficiently solid even in cases where the annular duct 12 is formed in the body of the fixing collar 10.

Nitrogen is not suitable for use as the protective gas because it causes the formation of nitrides. Argon is generally used although propane, methane or town gas may also be used.

It is obvious that the invention is not limited to the embodiments described and that any modifications may be made to the shape, arrangement and structure of certain constituent elements thereof without departing from the scope of the invention.

We claim:

1. A casting tube (8) of a refractory material having an upper end with openings defined therein for the injection of a protective gas during casting into a stream of molten metal flowing through the tube to prevent oxidation of the metal and to cool the walls of the casting tube, the tube having a frustoconical part at said upper end whose outer surface defines a fixing collar (10) for mounting to a base plate (2) of a discharge opening (3) of a casting ladle (1), and in which injection grooves (11) are formed along circumferentially spaced generatrices of the frustum, said injection grooves being interconnected at their upper end by an annular passage (12) communicating through a supporting ring (14) with a source of protective gas.

2. A casting tube as claimed in claim 1, wherein the injection grooves are equally spaced around said frustum.

3. A casting tube as claimed in claim 1, wherein the annular passage connecting said injection grooves is formed by the inner wall of the fixing collar of the casting tube and the outer wall of an element (18) which fits into said casting tube.

4. A casting tube as claimed in claim 1, wherein the annular passage is formed in the body of the fixing collar of the casting tube.

5. A casting tube as claimed in claim 1, wherein the source of protective gas is argon.

* * * * *